US005819470A

United States Patent [19]

Kionecka et al.

[11] Patent Number: 5,819,470

[45] Date of Patent: Oct. 13, 1998

[54] TURNSTILE WITH READILY ACCESSIBLE HEAD COMPARTMENT

[75] Inventors: Joseph A. Kionecka, deceased, late of Parma, by Joan M. Kionecka, executrix; Marilyn J. Evasovic, Brunswick; Joseph P. Grill, Hinckley, all of Ohio

[73] Assignee: General Nucleonics, Inc., Brunswick, Ohio

[21] Appl. No.: 647,177

[22] Filed: May 9, 1996

[51] Int. Cl.[6] ..... E06B 11/08

[52] U.S. Cl. ..... 49/46; 49/47

[58] Field of Search ..... 49/42, 47, 46, 49/141

[56] References Cited

PUBLICATIONS

Perey Turnstiles, catalog pp. 3–7, undated.
ROBOT Access Control Hardware, catalog, one page, undated.
TOMSED Corporation, catalog, five pages, undated.
Alvarado Seurity Turnstiles, caatalog, pp. 4–7, undated.
Controlled Access, Inc., catalog, pp. 4–7 and cover page, undated.

*Primary Examiner*—Daniel P. Stodola
*Assistant Examiner*—Curtis Cohen

[57] ABSTRACT

A turnstile structure has a control head contained in a readily accessible head compartment assembly. The head compartment assembly contains the control head in a cavity within the assembly and the turnstile control assembly, e.g., turnstile arms, extend outwardly from the control head and away from the head compartment. The head compartment assembly is fastened to a turnstile structure main frame at two principle edges of the assembly. Along one of these principle edges, the head compartment assembly is hinged to the main frame. At the other principle edge, the head compartment assembly is releasably secured to the main frame. These connections can provide for access to the control head through either tilting the head compartment assembly upwardly to expose the assembly cavity, in one structural embodiment, or downwardly to expose the cavity in another structural embodiment. The novel head compartment assembly is useful in not only preparing newly made turnstile structures, but also in refurbishing existing structures. The turnstile may also be equipped with a novel base plate, in addition to the novel head compartment assembly.

20 Claims, 6 Drawing Sheets

TURNSTILE WITH READILY ACCESSIBLE HEAD COMPARTMENT

BACKGROUND OF THE INVENTION

This invention pertains to personnel control systems and more particularly to rotary turnstile devices having extending arms which facilitate controlled passage between separated areas.

The invention is particularly applicable to turnstiles providing an extended arm across a passageway controlling movement of personnel between two distinct areas through the passageway. The turnstile may monitor as well as control the passageway. The turnstile might serve as a handicap gate. It could be wall-mounted, or portable. The turnstile could be a tandem unit providing dual passageways, or could be a series of units providing multiple passageways. It will be appreciated by those skilled in the art that the invention can be adapted for use in a great variety of environments and applications.

Conventionally known turnstiles having an extended arm protruding from a head compartment assembly and across a passageway are well known. Such structures have a control means contained within a head compartment assembly and often a multiple arm assembly control means, typically a 3-arm assembly control means. In operation one arm is usually extending across the passageway while two of the three arms are depending below the extending arm and out of the passageway. As an individual moves past the structure, the extending arm is pushed and rotates with the individual proceeding through the turnstile and this rotation permits a depending arm to rotate upwardly behind the individual moving past the structure. This arm rotating upwardly then extends outwardly across the passageway on completion of the individual passing across the structure.

These conventionally known turnstile structures have an enclosed head compartment assembly. Assembly members are typically bolted or screwed together in secure fashion. However, in this construction the control means of the turnstile is contained within this enclosed head compartment. Thus for refurbishing, repairing or replacing the control means it has been laborious and time consuming to gain access to it by disassembling the head compartment assembly. The typical nuts, bolts, rivets or welds utilized in manufacturing the head compartment assembly do not lend themselves to ready disassembling, such as in field repair of the turnstile.

In addition, these head compartment assemblies can have little or no space to mount or maintain auxiliary equipment such as counters, indicating lights, electronic devices and/or interface boards, to name just a few.

It would be desirable to have a turnstile where easy access could be gained to the control means, such as for on-site repair, and where the head compartment assembly of the turnstile structure would contain sufficient space to mount and maintain auxiliary equipment.

SUMMARY OF THE INVENTION

The present invention provides a new and improved turnstile structure including an innovative head compartment assembly. This new and improved apparatus overcomes the problems, particularly encountered in the field, of ease of access to the control head and lack of sufficient mounting space. There is now also provided a turnstile structure where there can be ready access to a head compartment assembly for purposes such as collecting tokens or tickets or other similar items deposited in the turnstile during passage.

In one aspect, the invention is directed to a turnstile structure having a head compartment which houses at least a part of a turnstile control means, the turnstile structure comprising: a main frame comprising an upright back member; a head compartment assembly comprising: a top panel member projecting forwardly, and at least substantially horizontally, away from the main frame back member; a bottom panel member connecting with said top panel member at the forward projection thereof and extending rearwardly below the top panel member back toward the main frame back member, thereby forming a cavity between the top and bottom panel members, the bottom panel member having at least one bottom panel member aperture extending therethrough; hinge means fastened to one of the top and bottom panel members as well as to the main frame back member, hinging said the compartment assembly to the main frame; and securing means releasably securing the head compartment assembly to the main frame with at least a part of the securing means being fastened to the top or bottom panel member not having the hinge means; and with the turnstile structure further comprising control means having a control head contained within the cavity between the top and bottom panel members and an arm assembly extending from the control head through the bottom panel member aperture.

In another aspect, the invention is directed to the method of making a turnstile structure providing ready access to control means housed within the turnstile structure which method comprises: establishing a turnstile main frame comprising an upright back member; forming a head compartment assembly providing a cavity for containing the control means within the cavity, the head compartment assembly comprising a top panel member connecting with a bottom panel member; hinging at least one of the top and bottom panel members to the main frame back member; and releasably securing the unhinged top and bottom panel member to the main frame back member.

In a yet further aspect, the invention comprises a turnstile structure having a head compartment assembly providing a cavity for containing the control means of a turnstile structure, which head compartment assembly comprises: a top panel member; a bottom panel member connecting with the top panel member and extending downwardly underneath the top panel member thereby forming a cavity between the top and bottom panel members, the bottom panel member having at least one bottom panel member aperture extending therethrough; hinge means fastened to one of the top and bottom panel members; and securing means fastened to the top or bottom panel member not having the hinge means.

In a still further aspect, the invention comprises a head sheet element adapted for forming a unitized assembly of panel members providing a housing for control means of a turnstile structure, the head sheet element comprising an essentially square thin metal sheet capable of bending to form the panel members, the head sheet element having at least substantially top half and at least substantially bottom half with there being a bottom panel member aperture through the bottom half providing at least about 10% of open area in the bottom half of the sheet element.

Another aspect of the invention is directed to the method of refurbishing a turnstile structure having a head compartment assembly comprising control means with arm assembly and control head, which head compartment assembly is secured to a turnstile structure main frame, which method comprises: separating the head compartment assembly from the main frame; removing the control means with arm assembly and control head from the head compartment assembly; enclosing the control means with arm assembly and control head in a head compartment assembly comprising: a top panel member; a bottom panel member connecting to, and angled downwardly underneath, the top panel member, thereby forming a cavity there between; hinge means affixed to one of the top and bottom panel members; and securing means fastened to the top or bottom panel member not having the hinge means; attaching the hinge means to the main frame thereby hinging the head compartment assembly to the main frame; and providing fastening means on the main frame and releasably securing the securing means to the main frame.

In yet another aspect, the invention is directed to a base plate structure adapted for use over a subjacent floor surface and under the control means of a turnstile structure, which base plate structure comprises: a main plate member having top and bottom major faces, front and back edges and near and far side edges; front and back beveled edge members at the front and back edges of the main plate member and beveled outwardly and downwardly from the plate member to extend to the floor surface; side panels at the side edges of the main plate member depending downwardly from the main plate member to extend to the floor surface; and base stiffener means on the bottom major face of the main plate member, depending from the bottom major face to said floor surface.

The invention is also directed to the method of making a base plate structure adapted for use over a subjacent floor surface under the control means of a turnstile structure, which method comprises: establishing a main plate member having top and bottom major faces, front and back edges and near and far side edges; forming front and back beveled edge members at the front and back edges of the main plate member, with the edge members beveled outwardly and downwardly from the main plate member to extend to the floor surface; providing side panels at the side edges of the main plate member, with the side panels depending downwardly from the main plate member to the floor surface; and stiffening the main plate member with base stiffening means at the bottom major face of the main plate member and depending from the bottom major face to the floor surface.

BRIEF DESCRIPTION OF THE DRAWINGS

Further features of the present invention will become apparent to those skilled in the art to which the present invention relates from reading the following specification with reference to the accompanying drawings, and which.

DESCRIPTION OF THE PREFERRED EMBODIMENTS

Figure 1:
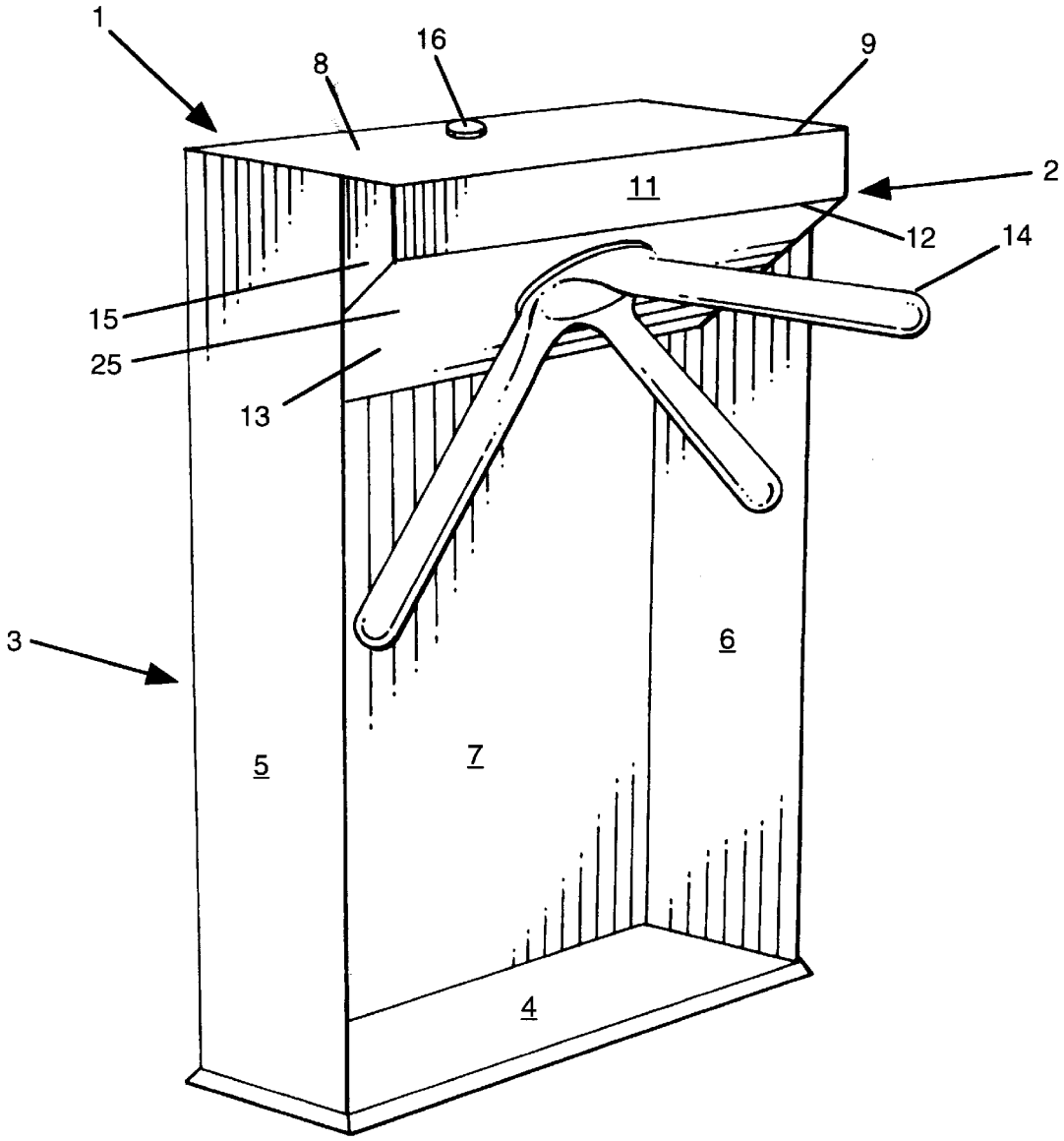
FIG. 1 is a perspective view of a representative turnstile structure of the present invention having a head compartment assembly mounted at the top of a main frame.

Referring now to the drawings wherein the figures are presented for illustrating representative embodiments of the invention, and should not be construed as limiting the invention, FIG. 1 shows a turnstile structure 1, which is positioned vertically, having a head compartment assembly 2 and a main frame 3. The main frame 3 has a base member 4, a near side member 5, a far side member 6, and a back member 7. These side and back members 5, 6, and 7 have at least substantially vertical positioning. At the top of the main frame 3, between the side members 5,6 and positioned against the back member 7 is the head compartment assembly 2. This head compartment assembly 2 has a top panel member 8 that projects forwardly from the main frame back member 7 and in an at least substantially horizontal position. This top panel member 8 extends forwardly to a top forward edge 9, and at said top forward edge 9, the top panel member 8 connects to a face member 11. This face member 11 projects downwardly from its connection with the top panel member 8 at the top forward edge 9. In turn, this face member 11 connects with a bottom forward edge 12 of a bottom panel member 13. The bottom panel member 13 extends at an angle downwardly underneath, or below, the top panel member 8 and rearwardly back towards the back member 7 of the main frame 3. Extending outwardly from the bottom panel member 13 and away from the outer major face 25 of this member, is an arm assembly 14 of the control means 10 of the turnstile structure 1. There is also depicted in the FIG. 1, near side panel member 15 for the head compartment assembly 2. Projecting upwardly from the top panel member 8, at the center back of the top panel member 8 is securing means releasably securing the head compartment assembly 2 to the main frame 3. In this embodiment a top latch key 16 forms part of the securing means.

Figure 2:
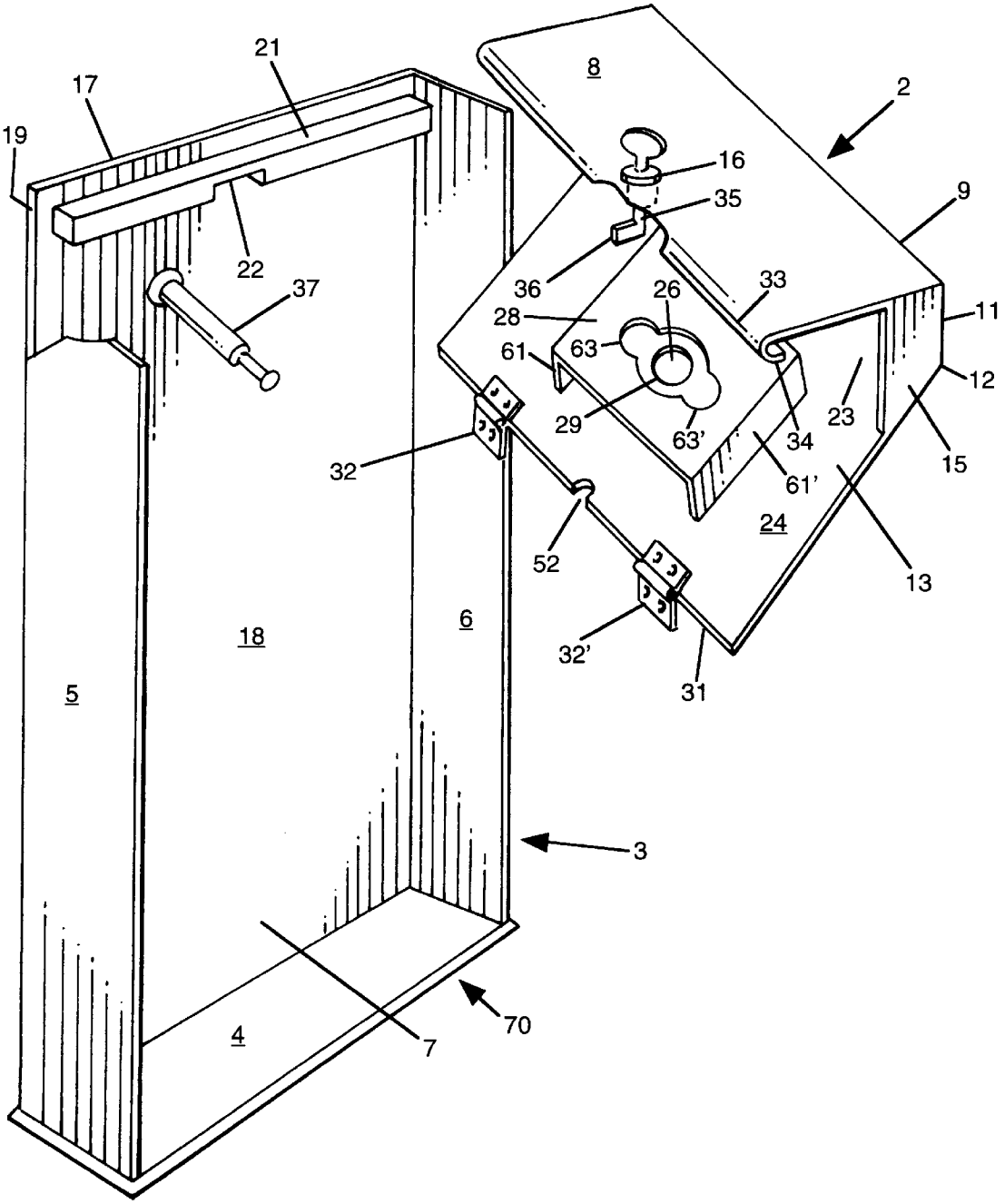
FIG. 2 is a side elevational view, in partial section, of the turnstile structure of FIG. 1 with the near side of the head compartment assembly swung away from the main frame.

Referring to FIG. 2, the main frame 3 has a base member 4, side members 5,6 and a back member 7. The back member 7 extends upwardly to a top edge 17. This back member 7 has a front major face 18 as well as a back major face (not shown). The back member 7 also has a near side edge 19 and the near side member 5 is secured to the back member 7 at this near side edge 19. Adjacent to the top edge 17 of the back member 7, and situated on the front major face 18 thereof, is a back stiffener bar 21. Toward the middle of this back stiffener bar 21 at its front lower edge there is a locking notch 22. The assembly preferably is made from a metal such as steel, stainless steel or cast aluminum.

Adjacent to the main frame 3, and swung outwardly therefrom, is a head compartment assembly 2. This head compartment assembly 2 has a top panel member 8 terminating forwardly in a top forward edge 9 and joining at such top forward edge 9 with a face member 11 (FIG. 1). The face member 11 connects the top panel member 8 to a bottom panel member 13, the connection being made at a bottom forward edge 12 of the bottom panel member 13. By the bottom panel member 13 extending downwardly underneath the top panel member 8 there is formed a cavity 23 between these top and bottom panel members 8, 13. This cavity 23 is also partly formed by a near side panel member 15 as well as far side panel member (not shown). These connect the top and bottom panel members 8,13 and the face member 11. The top and bottom panel members 8,13 together with the face member 11 provide, in cross section, a somewhat truncated V-shape for the head compartment assembly 2 and such term may be used herein to refer to this representative head compartment assembly 2 structure. The assembly preferably is made from a metal such as steel, stainless steel or cast aluminum.

The bottom panel member 13 has an inner major face 24 and an outer major face 25 (FIG. 1.). The inner major face 24 faces inwardly into the cavity 23. The bottom panel member 13 also contains a bottom panel member aperture 26 through which extend a arm assembly 14 (FIG. 1) from a control head 20 (not shown). Attached to the inner major face 24 is a bracket 28. This bracket 28 also contains, at its center, an bracket aperture 29, which has side lobes 63, 63'. Within the bracket aperture 29 there can be inserted a control head 20 (not shown). At the bottom back edge 31 of the bottom panel member 13 are hinge means 32, 32'. The hinge means 32, 32' at the bottom back edge 31 of the bottom panel member 13 are for fastening to the back member 7 of the main frame 3 on its front major face 18. Thus in this representative structure, the head compartment assembly 2 swings, or tilts, downwardly, i.e., away from the top edge 17 of the back member 7 and toward the base member 4 of the main frame 3 on the hinge means 32, 32', to expose the cavity 23. The bottom back edge 31 also contains a edge notch 52, which may be centrally located along the bottom back edge 31.

The top panel member 8 terminates rearwardly in a top back edge 33. This top back edge 33 is rolled down and in, providing a rolled inner edge 34 rolled inwardly within the cavity 23. At about the mid point laterally of the top panel member 8, adjacent to the back edge 33, is securing means in this embodiment shown as a key latch 35 having, on top of the top panel member 8 a top latch key 16 and a lower latch tab 36. The lower latch tab 36 engages with the locking notch 22 on the back stiffener bar 21.

In operation for access to the cavity 23, rotation of the top latch key 16 disengages the lower latch tab 36 from the locking notch 22 of the back stiffener bar 21. This action thus readily releases the head compartment assembly 2 and operates the dampening means 37. The head compartment assembly 2 then swings downwardly controlled by the operation of the dampening means 37 with the head compartment assembly 2 pivoting on the hinge means 32, 32'. This exposes the cavity 23, bracket 28 and the control head (not shown).

The stopping of the opening can be controlled by the dampening means 37. Pivoting the head compartment assembly 2 upwardly on the hinge means 32, 32' returns the head compartment assembly 2 to the closed position and positions the rolled inner edge 34 of the top panel member 8 over the back stiffener bar 21. The key latch 35 can then be rotated by means of the top latch key 16 to readily engage the lower latch tab 36 with the back stiffener bar 21. The dampening means 37 affixed to the front major face 18 of the back member 7, and also secured to the bottom panel member 13 at its inner major face 24, can provide for a gradual, rather than abrupt, tilting open of the head compartment assembly 2. Moreover the dampening means 37 can also provide for a stop position to the downward swing of the head compartment assembly 2. Such stop position may be preselected, e.g., advantageously stopping the bottom panel member 13 at an at least substantially horizontal positioning when the head compartment assembly 2 is fully opened.

Figure 2A:
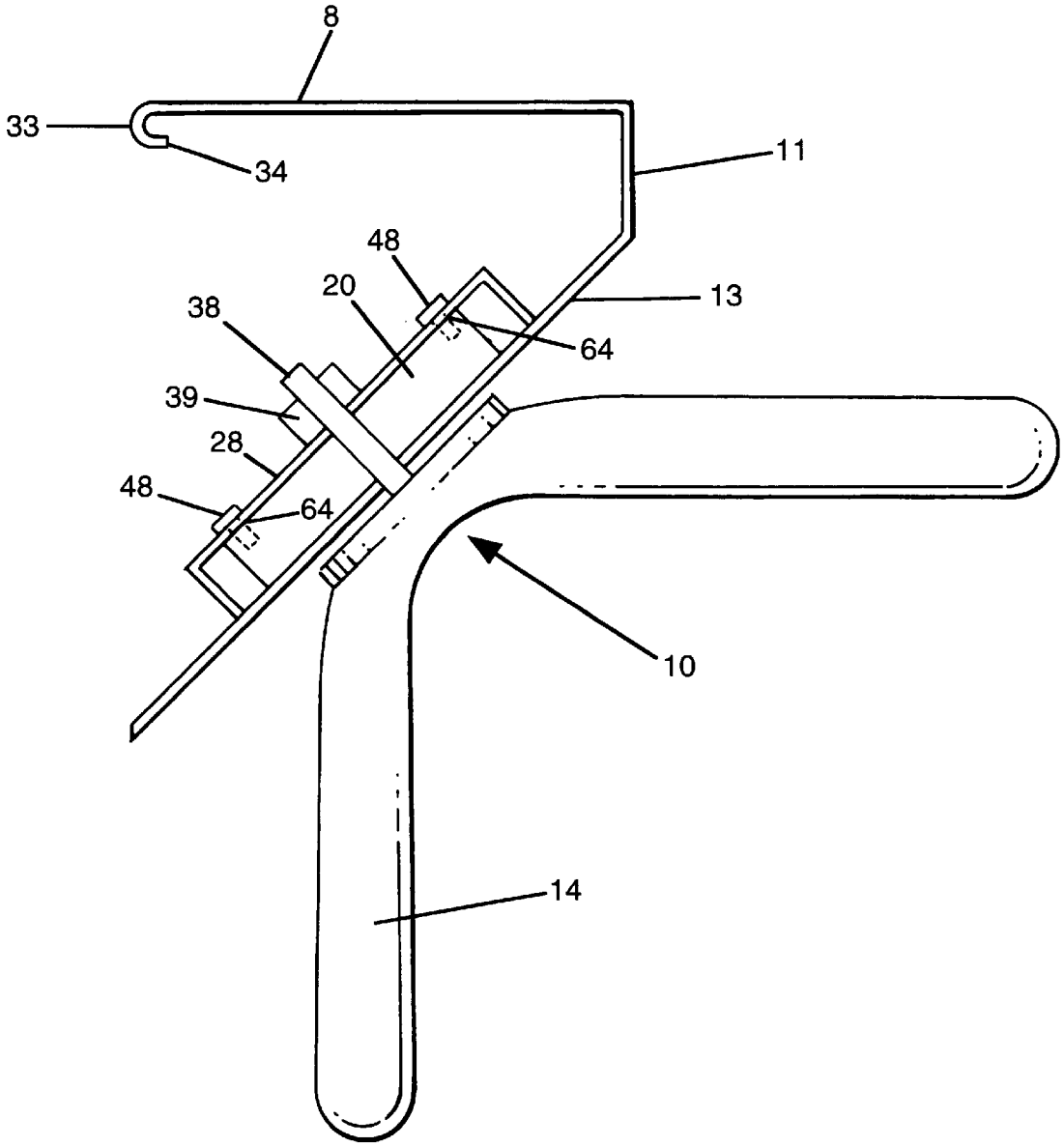
FIG. 2A is a cross sectional view of the head compartment assembly showing the control means mounted therein.

Referring now to FIG. 2A there is shown a cross sectional view of the head compartment assembly 2 with the control means 10 mounted therein. In this preferred embodiment the control means 10 is comprised of an arm assembly 14 and a control head 20. It is understood by those skilled in the art that the control head 20, instead of being the modular head as shown and described herein, may, also be a mechanism comprised of separate individual elements, mechanically interconnected in a fashion to effect the operation of the control means 10. The control head 20 is mounted on the bracket 28, in such a manner as to be between the bracket 28 and the inner major face 24. The arm assembly 14 connects to the control head 20 by way of a shaft 38 and extends downwardly through the bottom panel member aperture 26. The control head 20 is secured to the bracket 28 by means of bolts 48 extending through holes 64 in the bracket 28.

Figure 3:
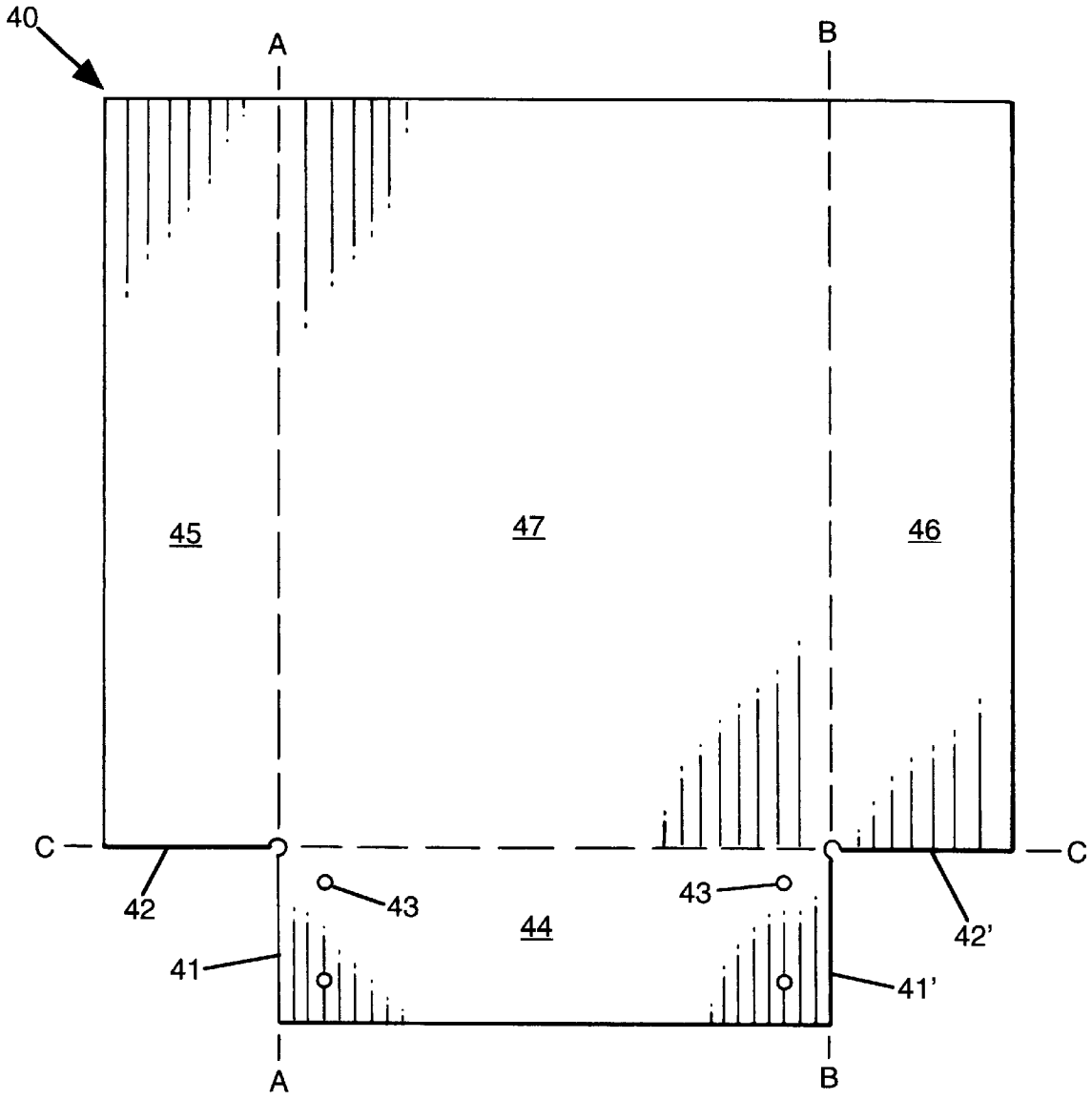
FIG. 3 is a top plan view of a sheet element for forming into a main frame.

In assembling the turnstile structure 1 as shown in the representative embodiment in FIG. 2, and referring now to FIG. 3, a main frame 3 may be formed as a unitized structure starting with a unit sheet or plate element being the main sheet 40. The main sheet 40 can have a main sheet area 47 for a back member 7 (FIG. 1) and near side panel 45 and far side panel 46 alongside the back member 7 to provide the near side member 5 and far side member 6, respectively. In forming the main frame 3 from the main sheet 40, initially near side panel 45 can be bent 90° along line A—A to provide near side member 5 and likewise near side panel 46 can be bent 90° along line B—B to provide near side member 6. Then a bottom flap 44 can be bent upwardly 90° along the bend line C—C. The side edges 41,41' of the bottom flap 44 will then meet with the near side panel edge 42 and the far side panel edge 42', respectively, to form the lower corners of the main frame 3. These edges 41,42 and 41',42' can be secured together by any conventional means for fastening together metal edges, e.g., welding such as tack welding. In the main sheet 40, the bottom flap 44 may have holes 43 through which fastening means can be used to secure the main frame 3 to a subjacent floor surface (not shown).

Figure 4:
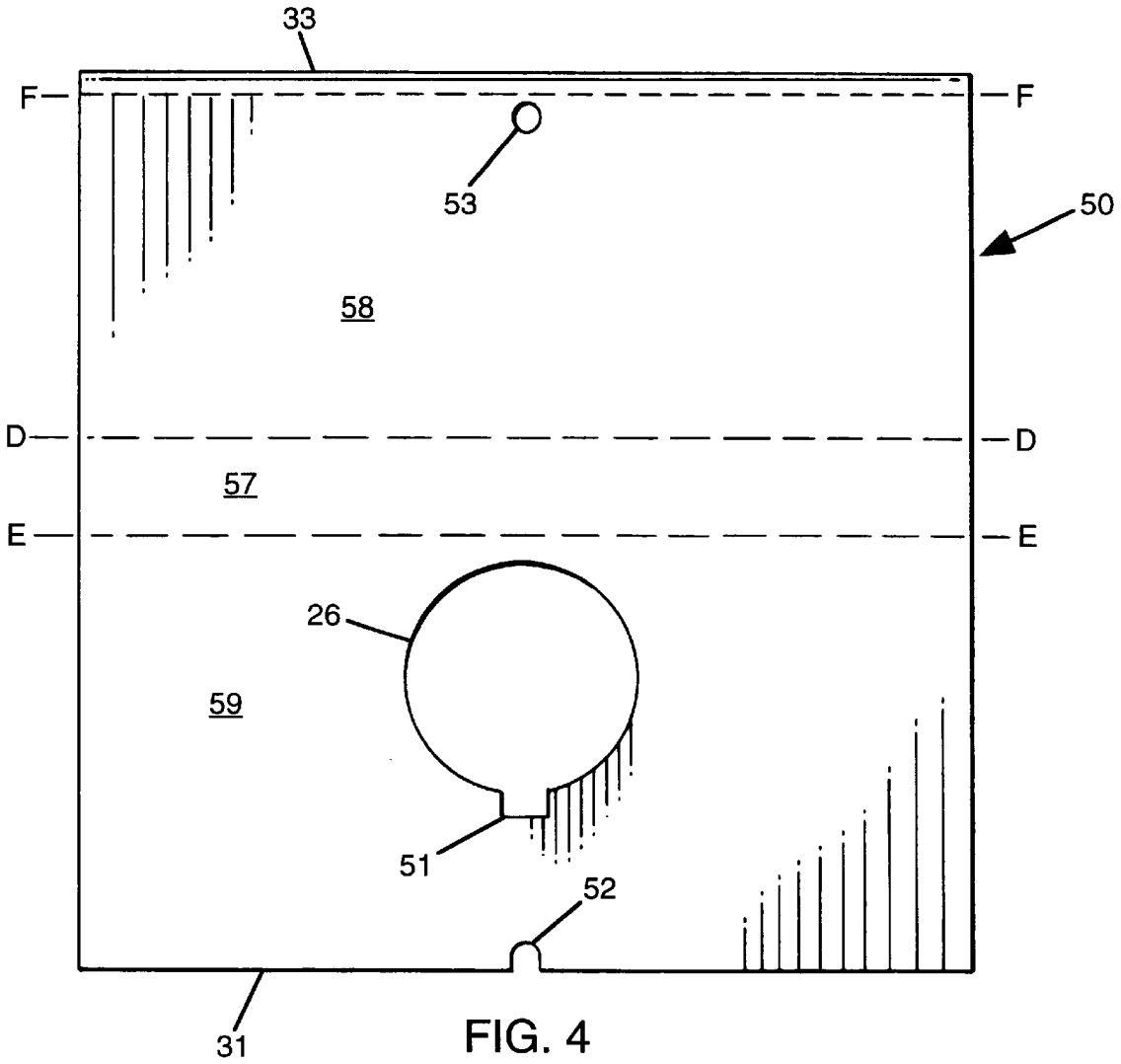
FIG. 4 is top plan view of a sheet element that can be shaped into a head compartment assembly.
Figure 4A:
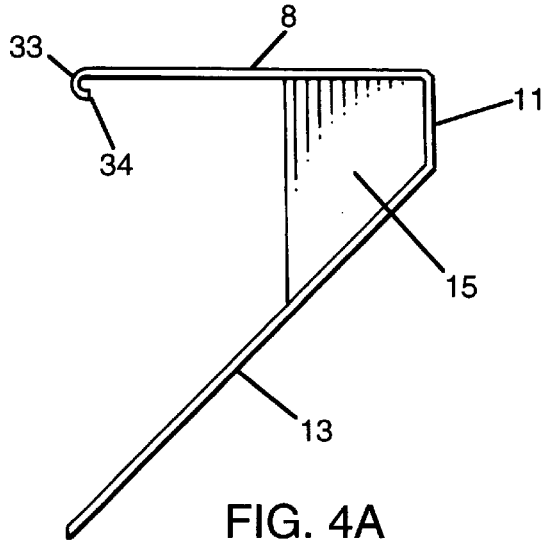
FIG. 4A is a cross sectional view of the sheet of FIG. 4 in formed condition, with side panel added.

Next, and referring now to FIGS. 4 and 4A, a unit sheet or plate element may also be employed as the head sheet 50 for providing the panel members of the head compartment assembly 2. The head sheet 50 can be, typically, in essentially square form. Starting with this head sheet 50 the top portion 58 can be bent 90° along the bend line D—D whereby the top portion 58 of the head sheet 50 above this bend line D—D can be used as a top panel member 8 (FIG. 4A). Next, the head sheet 50 can be bent along the bend line E—E so that the bottom portion 59 of the head sheet 50 is bent backwardly underneath the top panel member 8. The mid-section 57 of the head sheet 50 between the top and bottom portions 58,59 can provide for the face member 11 of the head compartment assembly 2. When this face member 11 is in vertical position (FIG. 4A), the bending back of the bottom portion 59 of the head sheet 50 will typically be at an angle back from the vertical of approximately 53°. This bent back bottom portion 59 then provides for the bottom panel member 13. In the bottom portion 59 is the bottom panel member aperture 26 which can be a circular aperture containing at its lower periphery a small notch 51 which serves to provide clearance for the head compartment assembly 2. At the bottom back edge 31 of the bottom panel member 13 is an edge notch 52. This edge notch 52 may serve to provide conduit access to the head compartment assembly 2. At the top of the head sheet 50 the top portion 58 top back edge 33 can be bent inwardly along the bend line F—F to provide a rolled inner edge 34 (FIG. 4A). Located centrally along this top back edge 33 of the top portion 58 is a top aperture 53 through which a key latch 35 (FIG. 2)

can be inserted. There can also be holes (not shown) along the bottom back edge 31 to which hinge means can be fastened.

After the head sheet 50 has been formed, and referring now specifically to FIG. 4A, it will be seen that the top panel member 8 can be in an essentially horizontal position. Then the 90° angle between the top panel member 8 and the face member 11 provides for essentially vertical positioning of this face member 11. The bending back underneath of the bottom panel member 13 can provide for a cavity 23 (FIG. 2) between the panel members 8,11 and 13. The forward area of these panel members 8,11 and 13 can be enclosed by side panel members such as near side panel member 15 of the head compartment assembly 2. The portion of the side area not enclosed by the near side panel member 15 will be enclosed by the near side member 5 of the main frame 3 (FIG. 1). As can be seen in FIG. 4A, the top back edge 33 of the top panel member 8 is a rolled inner edge 34.

Figure 5:
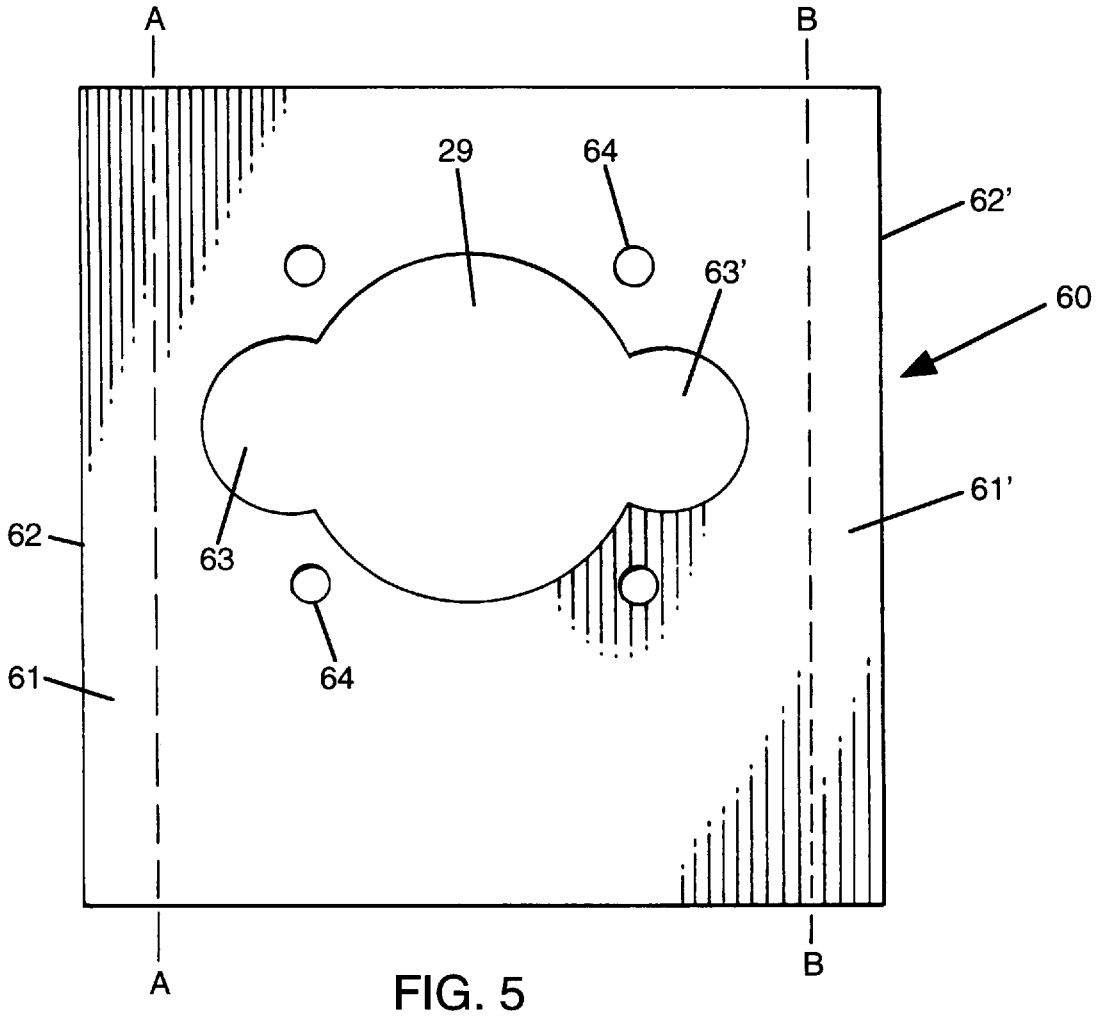
FIG. 5 is a top plan view of a head mounting bracket in sheet form before forming.
Figure 5A:
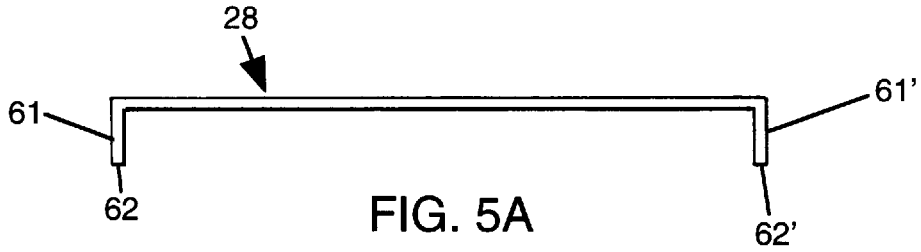
FIG. 5A is a cross sectional view of the head mounting bracket of FIG. 5 in formed position.

After forming of the head compartment members from the head sheet 50 of FIG. 4, further assembly steps can include installation of the bracket 28. For this, and referring now to FIGS. 5 and 5A, again a unitized sheet or plate element can be employed as a bracket sheet 60 which, typically, can be essentially square. To provide for spacing of the bracket 28 up from the bottom panel member inner major face 24 (FIG. 2), parallel opposite edges of the bracket sheet 60 can be bent downwardly at 90° to provide side flaps 61,61' (FIG. 5A). These side flaps 61,61' at their outer edges 62,62' can be placed on the bottom panel member inner major face 24 and secured thereto by any conventional means for fastening together metal members, such as welding, including tack welding. This bracket 28 will have a bracket aperture 29 which is generally circular, but has extending side lobes 63,63' positioned diametrically opposite one another at the perimeter of the circular edge of the bracket aperture 29. The bracket aperture 29 will be useful for engaging the control head 20 (not shown) of the turnstile structure 1. In this engagement, the side lobes 63,63' serve to accept rotary solenoids which comprise part of the control head 28 (not shown). Additionally, the bracket 28 can have small holes 64 positioned through the bracket sheet 60, and around the bracket aperture 29. These holes 64 allow mounting of the control head 20 to the bracket 28. Alternatively to the full length side flaps 61,61' at opposite edges of the bracket sheet 60, it will be understood that other flap or riser support arrangements as would occur to those skilled in the art could be employed, e.g., less than full length side flaps or flaps on all four sides of the bracket sheet 60.

After the bracket 28 has been formed from the bracket sheet 60 and secured to the inner major face 24 and the head compartment assembly 2 has been formed from the head sheet 50, hinges 32,32' can be affixed to the bottom back edge 31 of the bottom panel member 13. Then this bottom panel member 13 by means of the hinges 32,32' is fastened to the back member 7 of the main frame 3. A back stiffener bar 21 can be fastened adjacent to the top edge 17 of the back member 7. The locking notch 22 may be pre-cut into the back stiffener bar 21. The control head 20 can be mounted within the bracket 28 and the balance of the arm assembly 14 secured thereto. Additionally, a key latch 35 is secured within the top aperture 53 of the top panel member 8. Lastly dampening means 37 can be installed between the back member 7 and the bottom panel member 13. As will be understood, the foregoing sequence can be considerably varied to accommodate any assembly considerations occurring to those skilled in the art, e.g., the back stiffener bar 21 can be notched before or after fastening to the back member 7 and the key latch 35 may be the last part of the head compartment assembly 2, and so forth.

The turnstile structure 1 of FIGS. 1 and 2, it will be understood, is only a representative embodiment. Thus, for example, the top half of the main frame 3 may be used, and without side members 5,6 and a base member 4, to provide for a wall mounted turnstile structure 1. In any construction, the side panels 5,6 can be extended outwardly at their upper edges to replace the near side panel members 15 of the head compartment assembly 2. Also, back stiffener bars 21 may be utilized on any of the main frame members 4,5,6 and 7 and several may be used on any one member such as the back member 7. Additionally such back stiffener bars 21 can find utility in reinforcing any of the head compartment assembly panel members 8,11 and 13. It is moreover contemplated that back stiffener bars 21 may be replaced such as by angle reinforcements between main frame corners, such as the corners provided by the side edges 41, 41 and side panel edges 42, 42. Even the back stiffener bar 21 (FIG. 2) might be omitted and a notch cut within the back member 7 to receive the lower latch tab 36 of the key latch 35. The dampening means 37 can be a piston-type damper, or can be other means for providing a preselected stop position on opening of the head compartment assembly 2, e.g., a chain hooked between the back member 7 and the bottom panel member 13. The hinge means 32,32' are representative of any useful means for providing a fastening of the head compartment assembly 2 to the main frame 3 which permits the swinging of the head compartment assembly 2 open to expose the cavity 23. Thus the bottom back edge 31 of the bottom panel member 13 may contain a continuous hinge along the complete length of the bottom back edge 31 instead of two individual hinges as shown. The hinge means 32,32' can contain removable pins for ease of assembly and disassembly, or might contain springs whereby the head compartment assembly 2 is opened against the spring resistance of the hinge means 32,32', or such resistance might be provided by, or supplementing, a spring replacing the dampening means 37. The turnstile structure 1 may be provided with a locking means such as with the key latch 35, or separate from the key latch 35. Also, the key latch 35 may be replaced by other latching means. Although the representative embodiment of the figures shows the head compartment assembly 2 in cross section to be essentially a truncated V-shape, it will be understood by those skilled in the art that other suitable shapes can be useful. For example the cross section of the head compartment assembly 2 may subscribe essentially a parabolic curve as an example.

Although items such as the main frame 3, the panel members 8, 11 and 13, and the bracket 28 can be provided from unit sheet or plate elements, and such is preferred, other structure may be useful. For example the main frame 3 may be assembled from separate base member 4, side members 5,6 and back member 7, such as by welding together separate panels. It is preferred for durability and ease of assembly that the unit sheet or plate elements for main sheet 40, head sheet 50 and bracket sheet 60 be of 10 gauge steel. Although the bracket 28 has been shown to be useful for securing the control head 20 within the head compartment assembly 2, it will be understood by those skilled in the art that other securing means may be utilized.

In addition to the rolled inner edge 34, other edges can be changed. For example, the top edge 17, as well as other edges of the main frame 3, can be provided with a softened trim, e.g., of a polymeric material. Also, faces of members can be smoothed. Thus, where hinge means 32,32' are attached through the back member 7, the inner major face 24 of the main frame 3 may be worked to provide an at least substantially smooth back face.

As has been discussed herein, the top of panel member 8 of the head compartment assembly 2 connects with the bottom panel member 13, as for example at the forward projection of the top panel member 8. As will be understood, this connection need not be a direct connection, e.g., it can be a connection through intermediate panel members such as the face member 11 as shown in the figures. Moreover, the connection can be in a continuous manner, as where head compartment assembly 2 subscribes a parabolic arc in cross-section.

Figure 6:
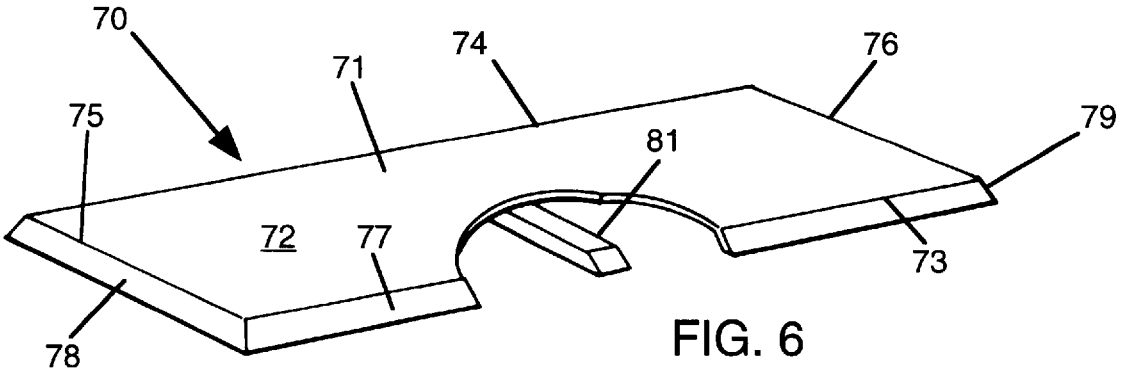
FIG. 6 is a perspective view of a base plate, in partial section, that can be used with the turnstile structure of FIG. 1.

As mentioned herein before, a base plate may be used with the turnstile structure 1. Referring then to FIG. 6, a base plate structure 70 which is particularly suitable for use with the turnstile structure 1, has a main plate member 71. This main plate member 71 is shown as a unit sheet or plate element and has a top major face 72 and a bottom major face (not shown). The main plate member 71 for the representative base plate structure 70 of FIG. 6 is an at least essentially rectangular sheet or plate element, although other shapes are contemplated. As an essentially rectangular sheet, the main plate member 71, it has near and far side edges 73,74 as well as front and back edges 75,76. The side edges can have side panels, e.g., the near side edge 73 has a side panel 77. The side panels including the side panel 77 are typically vertical panels which extend from the main plate member 71 to a subjacent floor surface (not shown).

At the front and back edges 75,76 there are beveled edge members, i.e., a front beveled edge member 78 and a back beveled edge member 79. As with a side panel 77, these beveled edge members 78,79 likewise extend from the main plate member 71 down to the surface of a subjacent floor. However, these beveled edge members 78,79 are not vertically upright, but are rather beveled, as at a 45° angle to the vertical. Providing extra support at essentially the middle of the main plate member 71 is a base stiffener means 81 which can be secured to the bottom major face of the main plate member 71.

Generally it is contemplated that the overall base plate structure 70 will be an essentially square or rectangular member, i.e., having four sides and at least substantially four right angles. However, it will be understood that other variations may be useful. In the particularly representative rectangular structure, it is advantageous for ease of assembly that the side edges 73,74 be at least substantially parallel to each other, and preferably are parallel, and that the front and back edges 75,76 be the same, i.e., preferably parallel to each other. Although the beveled edge members 78,79 have been discussed with regard to a 45° angle to the vertical, other angles for this beveling may be selected. The base stiffener means 81 can be more than one in number. Sufficient stiffener bars are advantageously used so that the main plate member 71 is stiff, i.e., not springy, under the condition of normal foot traffic across the main plate member 71. As seen in FIG. 6, the presence of a base stiffener means 81 as well as side panel such as the side panel 77 and the front and back beveled edge members 78,79, elevates the main plate member 71 from a floor surface. Thus any wiring or conduit or the like which may need to be conveyed to a turnstile structure 1 used in conjunction with the base plate structure 70, may be conveyed under the main plate member 71. Usually, for enhanced appearance as well as for mar and skid resistance, the base plate structure 70 is coated, particularly on the top major face 72. The coating selected is advantageously a coating which can maintain a desirable attractive appearance as well as provide mar and skuff resistance under heavy foot traffic which can be associated with a turnstile structure. Such coatings are well known to those skilled in the art and include baked on powder coatings, as well as electronically applied paints including polyurethane based powder coatings and paints.

Before coating, the base plate structure 70 may be assembled from metal members such as of steel, including stainless steel, or cast aluminum. Preferably for economy and ease of assembly, the base plate structure 70 is made of 10 gauge steel. The base plate structure 70 may be at least substantially produced from a unitized sheet or plate element, in a manner similar to the preparation of a main sheet 40, head sheet 50 and bracket sheet 60 as discussed hereinbefore. Where edges, such as of side panel 77, meet with the edges of the front and back beveled edge members 78,79, such can be joined together by any conventional means for joining metal members, advantageously by welding such edges together, including tack welding. In a similar manner, the base stiffener means 81 is generally tack welded to the bottom major face of the main plate member 71. Although the base stiffener means 81 has been shown to be a solid bar, it is understood that other similar bar material, e.g., channel material, can be useful. Rather than produced from a unit sheet, it is contemplated that the base plate structure 70 may be assembled from the various members as separate elements, including separate side panel members, front and back beveled edge members 78,79, main plate member 71 and base stiffener means 81. These separate elements can be joined together to make the base plate structure 70, such as by welding.

It is claimed:

1. A turnstile structure comprising a main frame including an upright back member; a turnstile control; and a head compartment assembly hingedly joined to the main frame back member and housing at least a part of the turnstile control, the head compartment assembly comprising:

a. a top panel member projecting forwardly, and at least substantially horizontally, away from said main frame back member to form a top forward edge;

b. a bottom panel member connecting with said top panel member at the top forward edge thereof and extending rearwardly below said top panel member back toward the main frame back member, thereby forming a cavity between said top and bottom panel members, said bottom panel member having a bottom panel member aperture extending therethrough;

c. hinge means to pivotally join said head compartment assembly to said main frame; and d. securing means to releasably secure said head compartment assembly to said main frame with at least a part of said securing means being fastened to the top or bottom panel member not having said hinge means;

said turnstile control having a control head contained within the cavity between said top and bottom panel members and an arm assembly extending from said control head through said bottom panel member aperture.

2. The structure of claim 1 wherein said main frame has a base member positioned at the bottom of, and secured to, said back member and adapted for mounting on a subjacent floor surface, with said main frame also having side members secured to said back member along side edges of said back member.

3. The structure of claim 2 wherein said back member, base member and side members of the main frame are formed from a unitary sheet element.

4. The structure of claim 1 wherein said head compartment assembly further comprises a face member connected to said top panel member to form a top forward edge and projecting downwardly from said top forward edge and into connection with said bottom panel member to form a bottom forward edge, said bottom panel member extending at an angle downwardly and rearwardly, whereby said top panel member, face member and bottom panel member subscribe an at least substantially truncated V-shape for said head compartment assembly in cross section.

5. The structure of claim 4 wherein said top panel member, base member and bottom panel member are formed from a unitary sheet element.

6. The structure of claim 1 wherein said top panel member slopes gradually downwardly projecting away from said main frame back member and provides a continuous, curving connection with said bottom panel member, subscribing an at least substantially parabolic shape for said head compartment assembly in cross section.

7. The structure of claim 1 wherein said main frame further comprises at least one back stiffener bar and said head compartment assembly further comprises side panel members secured to side edges of said top and bottom panel members.

8. The structure of claim 1 wherein said main frame back member has a top edge, said top panel member is fastened by said hinge means to said main frame back member adjacent to said top edge, and said head compartment assembly swings upwardly at said top edge.

9. The structure of claim 1 wherein said main frame back member has front and back major faces, said bottom panel member extends rearwardly at an angle back from the vertical of about 53° to a bottom panel member back edge, said back edge is fastened by said hinge means to said back member front major face, and said head compartment assembly swings downwardly at said back edge.

10. The structure of claim 9 wherein said main frame back member has a smooth back major face adapted for mounting on a wall surface.

11. The structure of claim 9 wherein said head compartment assembly swings downwardly to a stop position providing an essentially horizontal positioning for said bottom panel member.

12. The structure of claim 1 wherein said bottom panel member has inner and outer major faces, said inner major face faces into said cavity, and said bottom panel member has a bracket for said control head affixed to said inner major face.

13. The structure of claim 1 wherein said hinge means fastens said head compartment assembly to said main frame back member along an edge of said head compartment assembly, said hinge means extending along a part only of the length of said edge.

14. The structure of claim 13 wherein said hinge means includes pins with spring loaded latches.

15. The structure of claim 1 wherein said head compartment assembly is releasably secured to said main frame back member by a key latch securing means having a key latch on said top or bottom panel member and positioned on said member at an edge situated adjacent to said main frame back member, said edge is a rolled inner edge which is rolled inwardly within said head compartment assembly cavity, and said key latch latches to a back stiffener positioned on a front major face of said main frame back member.

16. The structure of claim 1 wherein said control head connects through said bottom panel member aperture to an arm assembly having one arm extending across a turnstile structure passageway and two arms depending beneath said extending arm and out of said passageway.

17. The structure of claim 1 wherein said bottom panel member aperture comprises from about 10% to about 15% of the surface area of said bottom panel member.

18. The structure of claim 1 wherein a damper member connects from said head compartment assembly to said main frame and said head compartment assembly includes a locking means locking said head compartment assembly to said main frame.

19. The structure of claim 1 wherein said top and bottom panel members form a cavity and said control head fills only a minor portion of said cavity.

20. The structure of claim 1 wherein said main frame back member is composed of a metal selected from the group consisting of steel and cast aluminum, said head compartment assembly is composed of a metal selected from the group consisting of steel and cast aluminum.

* * * * *